US006208229B1

(12) United States Patent
Zindler et al.

(10) Patent No.: US 6,208,229 B1
(45) Date of Patent: Mar. 27, 2001

(54) MOULDED CASE POWER SWITCH HOUSING WITH REMOVABLY SECURED SECONDARY COVER

(75) Inventors: Mark Owen Zindler, Robinson Township; Joseph Bell Humbert, Monaca, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/544,831

(22) Filed: Apr. 6, 2000

(51) Int. Cl.[7] ..... H01H 13/04
(52) U.S. Cl. ..... 335/202; 200/293
(58) Field of Search ..... 335/202, 132; 200/292–308

(56) References Cited

U.S. PATENT DOCUMENTS 5,910,760 6/1999 Malingowski et al. .

FOREIGN PATENT DOCUMENTS 6-111659 * 6/1994 (JP) .
6-111707 * 6/1994 (JP) .
6-124639 * 6/1994 (JP) .
6-139899 * 6/1994 (JP) .

* cited by examiner

*Primary Examiner*—Lincoln Donovan
*Assistant Examiner*—Tuyên T. Nguyễn
(74) *Attorney, Agent, or Firm*—Martin J. Moran

(57) ABSTRACT

The secondary cover of a molded case power switch housing is removably secured in place to enclose cavities in the insulative resin of a primary cover by an attachment assembly which includes metal attachment members or inserts seated in recesses in the primary cover. These inserts have tapped apertures aligned with mounting holes in the secondary cover through which screw fasteners are inserted and threaded into the tapped apertures. Such metal to metal connections can be repeatedly coupled and decoupled without significant wear as the secondary cover is removed and reinstalled to gain access to auxiliary devices mounted in the cavities in the primary cover. The inserts have second mounting apertures through which self tapping screws extend into the primary cover or through mounting holes in the primary cover and into the resin of the base to mount the inserts on the primary cover and to secure the primary cover to the base.

12 Claims, 2 Drawing Sheets

19
37
35
21
5
6
3
LINE
LOAD
4
1
2
51
45
25
17
15
27
29
33'
31
11
23
27'
29
33'
31
33
47
31
33
1
41
49
47
27
13
7
9
5
47
43
47
3

MOULDED CASE POWER SWITCH HOUSING WITH REMOVABLY SECURED SECONDARY COVER

BACKGROUND OF THE INVENTION

Field of the Invention

This invention relates to power switches for interrupting current in electric power circuits. More particularly, it relates to a molded housing for such switches having a removable secondary cover which encloses recesses for auxiliary devices in a primary cover, and an attachment arrangement for repeatedly removing and replacing the secondary cover over the primary cover.

BACKGROUND INFORMATION

Power switches, such as circuit breakers, transfer switches and the like, used in low voltage (600 volts and below) electric power distribution systems commonly have a housing molded of an electrically insulative resin and are, therefore, referred to as molded case circuit breakers, transfer switches and the like. The molded housing includes a base and a cover which together form an enclosure in which are mounted one or more switch poles, a switch operating mechanism and, where appropriate, a trip device. Typically, the molded case circuit breaker has a trip device that responds to short circuits, and/or to persistent overcurrent conditions, by opening the main switch contacts to interrupt the current.

Often, it is desirable to provide additional features on the switch, sometimes as options. Such additional features can include a remote trip, an auxiliary switch which provides an indication of the open or closed state of the main switch contacts and/or a bell alarm which provides an indication that the trip device has been activated. In some installations, it is desirable to have the switch open on undervoltage or off frequency conditions to prevent damage to a protected load.

These additional features can be incorporated within the switch housing formed by the base and cover. However, in some instances, the devices providing the desired features are received in cavities formed in the cover of the housing. In this latter case, a secondary cover encloses the cavities in what has become the primary cover. The secondary cover should be easily removable for inserting, removing or servicing the devices providing the additional features. Typically, the secondary cover is removably secured to the molded housing by self-tapping screws. However, with repeated insertion and removal of these screws, the threads in the molded resin can be stripped out. One solution to this problem is to have fasteners that are retained in the secondary cover; however, these add to the cost and manufacturing effort required.

There is a need, therefore, for an improved molded case power switch housing and particularly for an improved arrangement for removably attaching a secondary cover to the molded housing. There is a more particular need for such an improved molded case power switch that does not require repeated insertion and removal of self-tapping screws into the molded housing.

There is an additional need for such an improved molded case power switch housing which is economical to manufacture and easy to use.

SUMMARY OF THE INVENTION

These needs and others are satisfied by the invention which is directed to a molded case power switch housing in which a secondary cover is removably secured over the primary cover to enclose cavities in the primary cover containing auxiliary devices by an attachment assembly which includes at least one, and preferably a plurality, of attachment members secured to the top face of the primary cover and having a mounting aperture which registers with a mounting hole in the secondary cover. First fasteners extend through the mounting holes in the secondary cover and engage the mounting aperture in the attachment member to removably secure the secondary cover to the primary cover. Preferably the mounting apertures and the attachment members are tapped apertures and the first fasteners have threaded shafts which are threaded into the tapped apertures. The attachment members are preferably metal so that the first fasteners can be repeatedly inserted and removed for mounting and removing the secondary cover repeatedly without becoming worn.

The attachment members can have second mounting apertures which are aligned with mounting holes in the primary cover and through which second fasteners extend to secure the attachment members to the primary cover. The mounting holes in the insulative resin of the primary cover can be tapped and the second fasteners have threaded shafts which engage the tapped resin holes. Even though the second fasteners are threaded into the insulative resin, the attachment is secure as these second fasteners do not have to be removed and reinserted each time the secondary cover is removed or installed.

Some of the attachment members are extended in length and have a third mounting aperture which is aligned with aligned apertures extending all the way through the primary cover and the base for receiving third fasteners which mount the molded case power switch housing such as to a panel board.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a housing for a molded case circuit breaker; however, it will become evident that the invention has application to molded case housings for other types of power switches such as for instance transfer switches or disconnect switches.

Figure 1:
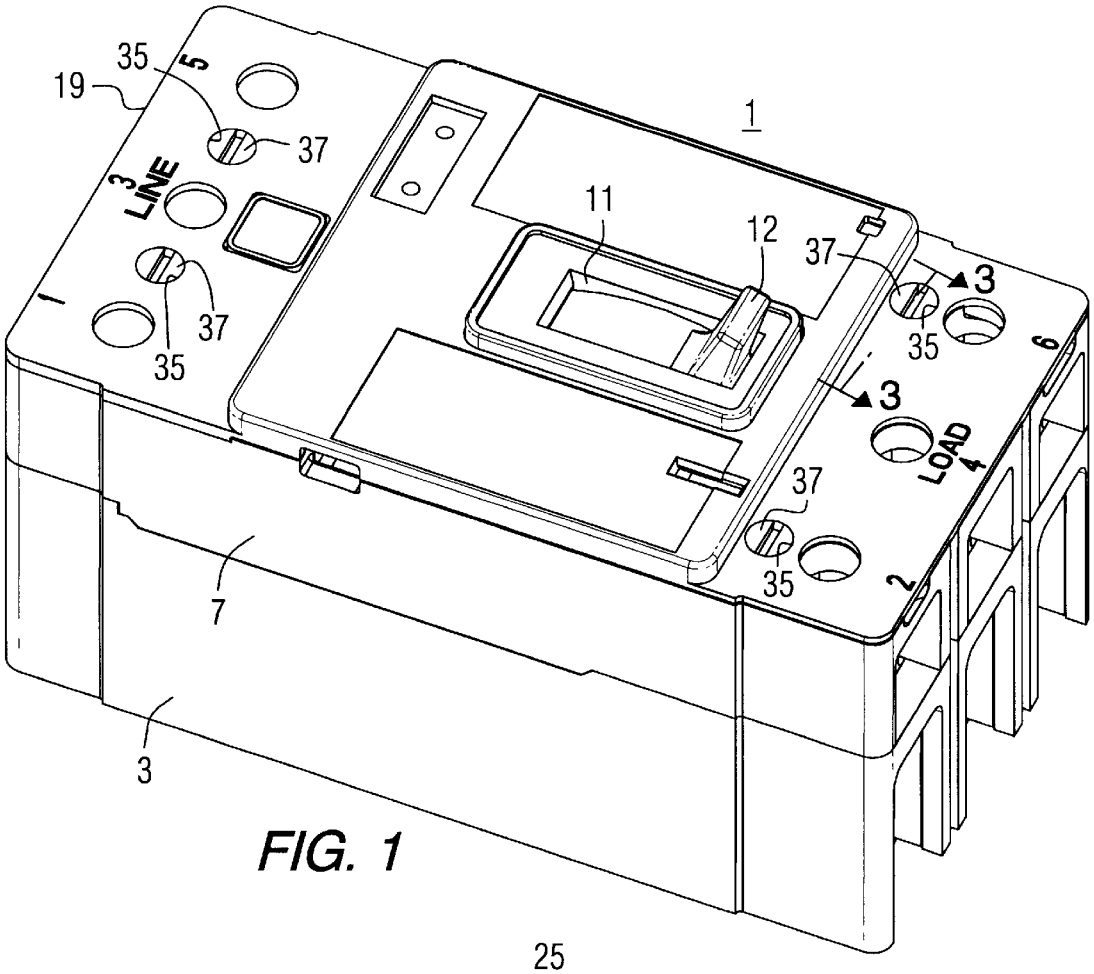
FIG. 1 is an exploded isometric view of a molded case power switch housing incorporating the invention.
Figure 2:
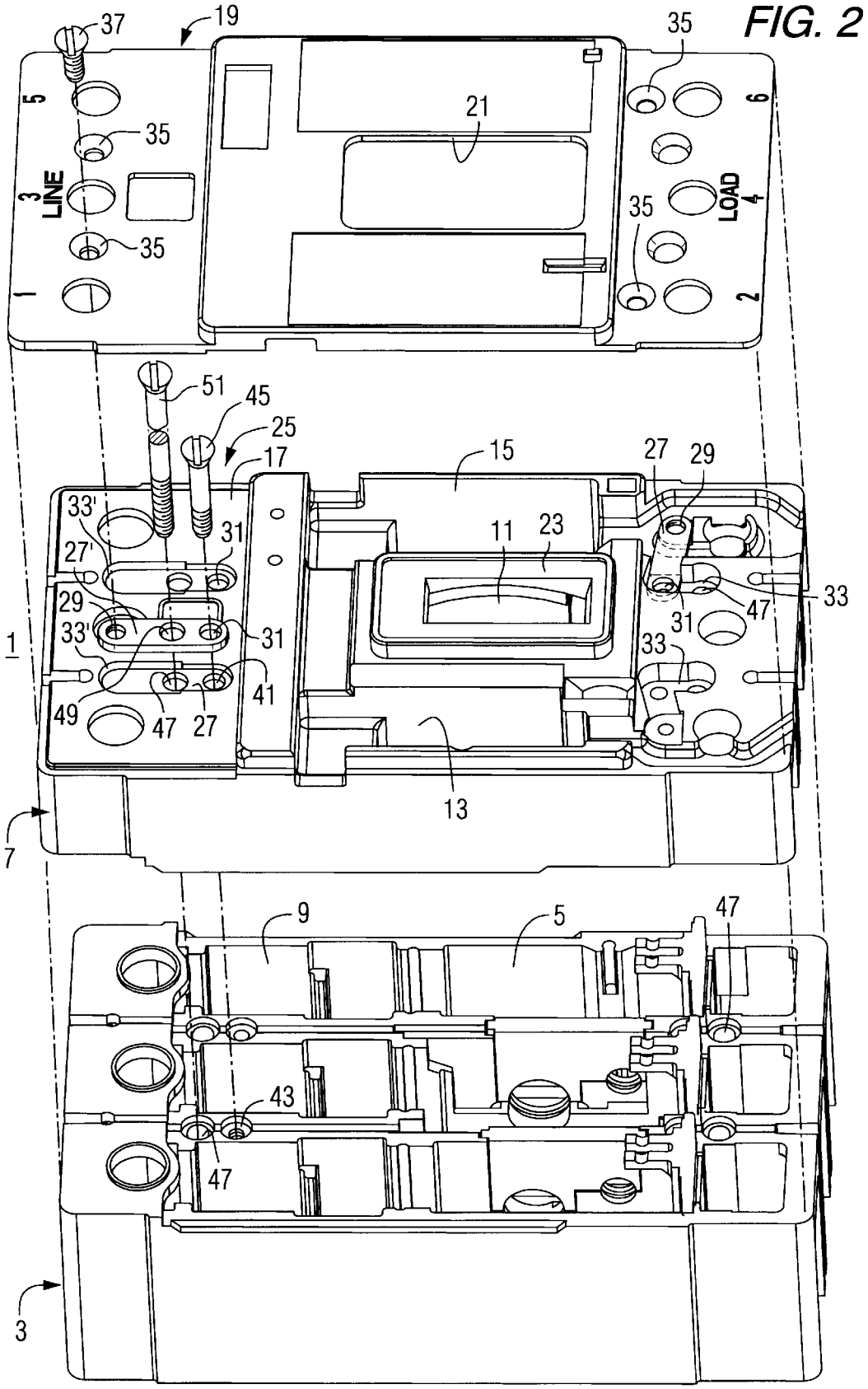
FIG. 2 is an isometric view showing a circuit breaker of FIG. 1 assembled.

Referring to FIGS. 1 and 2, the molded case circuit breaker housing 1 includes a molded base 3 having an open top 5. The housing 1 also includes a molded primary cover 7 which seats over the open top 5 of the base 3 to form an enclosure 9 in which poles and an operating mechanism (neither shown) of the circuit breaker are housed. The housing 1 shown is for a three pole circuit breaker for illustrative purposes only as the number of poles is not relevant to the invention.

The primary cover 7 has a generally central through opening 11 for a handle 12 of the operating mechanism (not shown). One or more cavities 13 and 15 are provided in the top surface 17 of the primary cover for auxiliary devices such as an undervoltage relay, a shunt trip module, an auxiliary switch, a bell alarm, or the like (none shown). Such optional devices may or may not be provided in the cavities 13 and 15.

The molded case circuit breaker housing 1 further includes a secondary cover 19 which seats on the primary cover 7 and covers the cavities 13 and 15 to enclose any auxiliary devices provided in these cavities. The secondary cover 19 has a handle opening 21 which registers with the handle opening 11 in the primary cover but is larger to accommodate the escutcheon 23 around the handle opening 11 which projects through the handle opening 21.

Figure 3:
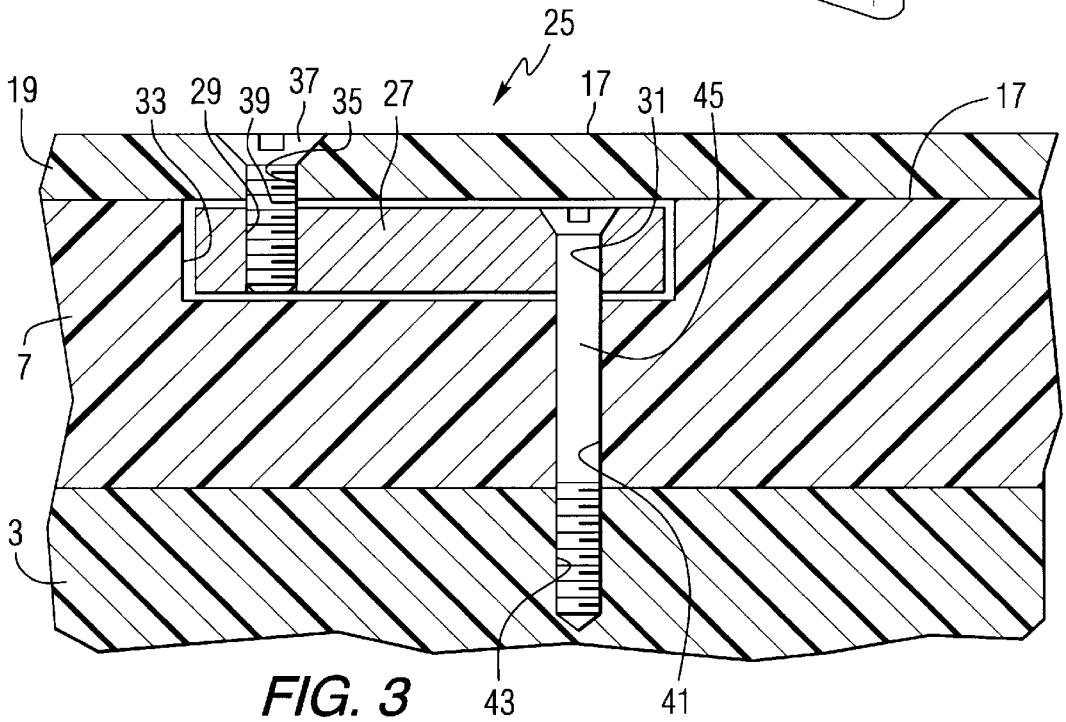
FIG. 3 is a fragmentary vertical section in enlarged scale taken along the line 3—3 in FIG. 1.

The secondary cover 19 and primary cover 7 are secured to each other and to the base 3 by an attachment assembly 25. This attachment assembly 25 includes an attachment member 27 in the form of an elongated flat insert with rounded ends. As can be seen from FIG. 3, the attachment members 27 have a first mounting aperture 29 adjacent one end and a second mounting aperture 31 adjacent the other end. These attachments members or inserts 27 are seated in recesses 33 in the top face 17 of the primary cover 7. The secondary cover 19 has mounting holes 35 which register with the first mounting apertures 29 in the inserts when the secondary cover is seated on the primary cover 7. The attachment assembly 25 further includes first fasteners 37 in the form of screws having threaded shafts 39 which extend through the mounting holes 35 in the secondary cover and thread into the first mounting apertures 29 in the inserts which are tapped.

The second mounting apertures 31 of the inserts 27 are aligned with primary cover mounting holes 41 which register with base mounting holes 43 when the primary cover is in place on the base. Second fasteners 45 in the form of elongated screws extend through the second mounting apertures 31 in the inserts 27, through the mounting holes 41 in the primary cover, and extend into the base mounting holes 43. The screws 45 are self tapping so that they form threads in the resin of the base as they are screwed into the holes 43.

Additional mounting holes 47 extend from the recesses 33 through the primary cover 7 and all the way through the base 3 for receiving additional fasteners (not shown) which can be used to mount the circuit breaker on a panel board or other mounting structure.

The inserts 27' seated in the recesses 33' at the line end of the housing, are extended in length and have a third aperture 49 between the apertures 29 and 31 for the additional fasteners 51 which extend through the insert 27' and all the way through the aligned holes 47 in the primary cover and the base for securing the circuit breaker housing to a panel board or other mounting structure. Additional fasteners (not shown) extend through the aligned holes 47 in the primary cover 7 and base 3 at the load end adjacent to but not through the attachment members 27 at that end.

Preferably, the attachment members or inserts 27 and 27' are made of metal or other durable material so that the screws 37 can be repeatedly inserted and removed without noticeable wear on the threads in the tapped apertures 29. Thus, the secondary cover 19 can be installed and removed as often as needed to insert, remove, and service any auxiliary devices that are mounted in the cavities 13 and 15 in the primary cover 7. All of this can be accomplished without the necessity of removing the primary cover 7. Hence, the fact that the primary cover 7 is secured to the base 3 by the self tapping screws 45 which form threads in the resin of the base as they are threaded into the base mounting holes 43 is not a factor as these fasteners rarely need to be removed or reinstalled.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A molded case power switch housing comprising:

a molded base having an open top;

a primary cover extending over said open top and secured to said molded base to form an enclosure, said primary cover having at least one cavity formed in atop face thereof;

a removable secondary cover which seats on said top face of said primary cover over said at least one cavity in said primary cover and has at least one mounting hole;

an attachment assembly comprising:

at least one attachment member secured to said top face of said primary cover and having a first mounting aperture which registers with said at least one mounting hole in said secondary cover;

at least one first fastener extending through said at least one mounting hole in said secondary cover and engaging said first mounting aperture in said attachment member to removably secure said secondary cover to said primary cover;

wherein said first mounting aperture in said at least one attachment member is a tapped aperture and said at least one first fastener has a threaded shaft which threads into said tapped aperture; and wherein said primary cover has at least one primary cover mounting hole, said at least one attachment member has a second mounting aperture aligned with said at least one primary cover mounting hole, and said attachment assembly includes a second fastener extending through said second mounting aperture in said attachment member and engaging said at least one primary cover mounting hole.

2. The molded case power switch housing of claim 1 in which said primary cover has a recess in said topface in which said at least one attachment member is seated.

3. The molded case power switch housing of claim 1 wherein said primary cover is an insulative resin cover and said at least one primary cover mounting hole is a resin hole in said insulative resin cover, and said second fastener has a threaded shaft which threads into said resin hole.

4. The molded case power switch housing of claim 3 wherein said attachment member is a metal member.

5. The molded case power switch housing of claim 4 in which said primary cover has a recess in said topface in which said at least one attachment member is seated.

6. The molded case power switch housing of claim 3 wherein said at least one resin hole in said primary cover comprises a plurality of resin holes, said at least one mounting hole in said secondary cover comprises a plurality of mounting holes, said at least one attachment member comprises a plurality of attachment members each having a first mounting aperture and a second mounting aperture, said at least one first fastener comprises a plurality of first fasteners each having a threaded shaft extending through one of said plurality of mounting holes in said secondary cover and threaded into a first mounting aperture in one of said attachment members, and said at least one second fastener comprising a plurality of second fasteners each having a threaded shaft extending through said second mounting aperture in one of said attachment members and threaded into one of said plurality of resin holes in said primary cover.

7. A molded case power switch housing comprising:

a molded base having an open top;

a primary cover extending over said open top and secured to said molded base to form an enclosure, said primary cover having at least one cavity formed in a top face thereof;

a removable secondary cover which seats on said top face of said primary cover over said at least one cavity in said primary cover ad has at least one mounting hole;

an attachment assembly comprising:

at least one attachment member secured to said top face of said primary cover and having a first mounting aperture which registers with said at least one mounting hole in said secondary cover;

at least one first fastener extending through said at least one mounting hole in said secondary cover and engaging said first mounting aperture in said attachment member to removably secure said secondary cover to said primary cover;

wherein said first mounting aperture in said at least one attachment member is a tapped aperture and said at least one first fastener has a threaded shaft which threads into said tapped aperture; and wherein said primary cover has at least one primary cover mounting hold, said at least one primary cover mounting hole, said at least one attachment member has a second mounting aperture aligned with said at least one primary cover mounting hole and said base has at least one base mounting hole aligned with both said at least one primary cover mounting hole and said second mounting aperture of said at least one attachment member, and said attachment assembly includes at least one second fastener which extends through said second mounting aperture of said at least one attachment member, said at least one primary cover mounting hole, ad is secured in said at least one base mounting hole to secure said at least one attachment member to said primary cover and secure said primary cover to said base.

8. The molded case power switch housing of claim 7 wherein said at least one mounting hole in said secondary cover comprises a plurality of secondary cover mounting holes, said at least one attachment member comprises a plurality of attachment members each having a tapped first mounting aperture aligned with one of said secondary cover mounting holes, said at least one primary cover mounting hole comprises a plurality of primary cover mounting holes, said plurality of attachment members each having a second mounting aperture aligned with one of said plurality of primary cover mounting holes, said at least one base mounting hole comprising a plurality of base mounting holes each aligned with one of said plurality of primary cover mounting holes and a said second mounting aperture in one of said plurality of attachment members and wherein said at least one first fastener comprises a plurality of threaded first fasteners extending through one of said plurality of secondary cover mounting holes and threaded into one of said plurality of tapped first mounting apertures in one of said plurality of attachment members, and said at least one second fastener comprises a plurality of second fasteners each extending through a said second mounting aperture in one of said plurality of attachment members, through one of said plurality of primary cover mounting holes and engaging one of said base mounting holes to secure said plurality of attachment numbers to said primary cover and to secure said primary cover to said base.

9. The molded case power switch of claim 7 wherein said primary cover and said base each have at least one aligned additional mounting hole extending through said primary cover and base, and said at least one attachment member has a third mounting aperture aligned with said additional mounting hole in said primary cover and said base, and said attachment assembly includes a third fastener extending through said third mounting aperture in said at least one attachment member and said aligned additional mounting holes in said primary cover and said base.

10. The molded case power switch of claim 9 wherein said at least one mounting hole in said secondary cover comprises a plurality of secondary cover mounting holes, said at least one attachment member comprises a plurality of attachment members each having a tapped first mounting aperture aligned with one of said secondary cover mounting holes, said at least one primary cover mounting hole comprises a plurality of primary cover mounting holes, said plurality of attachment members each having a second mounting aperture aligned with one of said plurality of primary cover mounting holes, said at least one base mounting hole comprising a plurality of base mounting holes each aligned with one of said plurality of primary cover mounting holes and a said second mounting aperture in one of said plurality of attachment members, said at least one aligned additional mounting holes in said primary cover and base comprise a plurality of additional mounting holes, said plurality of attachment members each having a third mounting aperture aligned with one of said plurality of aligned additional mounting holes, and wherein said at least one fastener comprises a plurality of threaded first fasteners extending through one of said plurality of secondary cover mounting holes and threaded into one of said plurality of tapped first mounting apertures in one of said plurality of attachment members, said at least one second fastener comprises a plurality of second fasteners each extending through a second mounting aperture in one of said plurality of attachment members, through one of said plurality of primary cover mounting holes and engaging one of said base mounting holes to secure said plurality of attachment members to said primary cover and to secure said primary cover to said base, and said at least one-third fastener comprises a plurality of third fasteners each extending through a said third mounting aperture in one of said plurality of attachment members and through one of said plurality of aligned additional mounting holes in said primary cover and base.

11. The molded case power switch housing of claim 9 wherein said plurality of attachment members are a plurality of metal members, said first mounting apertures in said attachment members are tapped apertures, and said first fasteners have threaded shafts which thread into said tapped apertures.

12. A molded case power switch housing comprising:

a molded base having an open top;

a primary cover extending over said open top and secured to said molded base to form an enclosure, said primary cover having at least one cavity formed in a top face thereof;

a removable secondary cover which seats on said top face of said primary cover over said at least one cavity in said primary cover and has at least one mounting hole;

an attachment assembly comprising:

at least one attachment member secured to said top face of said primary cover and having a first mounting aperture which registers with said at least one mounting hole in said secondary cover;

at least one first fastener extending through said at least one mounting hole in said secondary cover and engaging said first mounting aperture in said attachment member to removably secure said secondary cover to said primary cover; and wherein said at least one mounting hole in said secondary cover comprises a plurality of mounting holes, said at least one attachment member comprises a plurality of attachment members secured to said top face of said primary cover and each having a first mounting aperture, and said at least one first fastener comprises a plurality of first fasteners each extending through one of said plurality of mounting holes in said secondary cover and engaging said mounting aperture in one of said plurality of attachment members.

* * * * *